United States Patent [19]

McDowell et al.

[11] Patent Number: 4,649,729

[45] Date of Patent: Mar. 17, 1987

[54] METHOD FOR MANUFACTURING STEEL BAR WITH INTERMITTENT SMOOTH SURFACE AND PATTERNED RELIEF SEGMENTS, AND MINE ROOF BOLT PRODUCT

[75] Inventors: A. Dale McDowell, Matthews, N.C.; George S. Vass, Marietta, Ohio

[73] Assignee: Florida Steel Corporation, Charlotte, N.C.

[21] Appl. No.: 691,141

[22] Filed: Jan. 14, 1985

[51] Int. Cl.[4] ..... B21H 8/02

[52] U.S. Cl. ..... 72/185; 52/737; 405/259

[58] Field of Search ..... 72/194, 198, 185; 52/737, 738, 739, 740; 405/259

[56] References Cited

U.S. PATENT DOCUMENTS

| | | | |
|---|---|---|---|
| 440,095 | 11/1890 | Wyland | 72/194 |
| 1,577,430 | 3/1926 | Witherow | 72/185 |
| 1,635,658 | 7/1927 | Boardman | 52/740 |
| 1,998,970 | 4/1935 | Sloan | 72/198 |
| 3,653,217 | 4/1972 | Williams | 61/45 B |
| 3,693,359 | 9/1972 | Karara | 405/259 |
| 4,040,232 | 8/1977 | Snow et al. | 52/738 |
| 4,064,729 | 12/1977 | Homery | 72/257 |
| 4,112,637 | 9/1978 | Herbst | 405/259 |
| 4,303,354 | 12/1981 | McDowell | 405/261 |
| 4,338,807 | 7/1982 | Ricoco et al. | 72/187 |
| 4,589,803 | 5/1986 | Totten | 405/259 |

FOREIGN PATENT DOCUMENTS

| | | | |
|---|---|---|---|
| 1574005 | 7/1969 | France | 405/259 |

*Primary Examiner*—Lowell A. Larson

*Attorney, Agent, or Firm*—W. Thad Adams, III

[57] ABSTRACT

A method is disclosed for manufacturing steel bar (10) with intermittent smooth surface segments (11) and patterned relief segments (12). The method includes the steps of heating the bar (10) to a semiplastic state, rolling the semiplastic metal bar between rollers (30) having segments of patterned relief (33) around their respective circumferences separated by intermittent smooth segments (34). The rollers (30) rotate in registration with each other thereby imparting a corresponding intermittent pattern to the surface of the bar (10) along its length. The metal bar is then cooled to a solid state with the intermittent pattern intact on the surface of the bar. The metal bar (10) has intermittent segments of patterned relief (12) separated by intermittent smooth segments (11), the intermittent segments of patterned relief (12) being rolled onto the surface of the bar by passing the bar in a semiplastic state between rollers (30) having corresponding patterned relief (33) around their respective circumferences. The metal bar (10) has particular application as mine roof bolts when cut to an appropriate length and threads (14) are formed on one end of the bar to receive a threaded nut (15).

4 Claims, 8 Drawing Figures

| THICKNESS | WIDTH |
|---|---|
| | |
| $1\frac{1}{16}$ | $2\frac{5}{16}+$ |
| $1\frac{7}{16}+$ | $1\frac{7}{16}$ |
| $\frac{13}{16}$ | $2\frac{7}{16}-$ |
| $1\frac{1}{16}$ | |
| $\frac{11}{16}$ | $1\frac{9}{16}$ |
| $1\frac{1}{16}$ | $1\frac{1}{16}$ |
| $\frac{11}{16}$ | $1\frac{5}{16}$ |
| $\frac{43}{64}$ | |

METHOD FOR MANUFACTURING STEEL BAR WITH INTERMITTENT SMOOTH SURFACE AND PATTERNED RELIEF SEGMENTS, AND MINE ROOF BOLT PRODUCT

TECHNICAL FIELD AND BACKGROUND OF THE INVENTION

This invention relates to a method for manufacturing steel bar having intermittent smooth surface segments and patterned relief segments. The steel bar thus manufactured is easily transformed by further processing into mine roof bolts in the manner described below.

The invention according to this application is related to an existing product which is generically referred to as reenforcing bar or "rebar." Therefore, the term "rebar" will be used in this application to mean a substantially round in cross-section steel bar having a raised pattern integrally formed on its surface. Rebar is typically used in concrete construction to reinforce a concrete structure by forming a web which is completely encased in concrete. The raised pattern on the surface of the bar forms gripping surfaces around which the concrete hardens. Once the concrete hardens, shifting is prevented by the outwardly protruding pattern on the bar.

Rebar bar has also been used in the mining industry. In many types of underground mines, safety regulations and good mining practice require that a suspended ceiling be bolted into place over the roof of the mine shaft. This is accomplished by drilling a series of spaced-apart, vertically extended holes in a mine shaft ceiling. An epoxy material is placed in each hole and then a length of steel reinforcing bar is inserted into the hole. The epoxy hardens around the rebar and holds it in place. Typically, 6 to 12 inches of the rebar extends downwardly from the plane of the ceiling and is threaded to receive a bolt. A ceiling panel having suitably spaced holes is placed on the ceiling with the rebar extending downwardly through the holes. Then, bolts are threaded onto the bars and the ceiling is suspended in place. Heretofore, the type of rebar used has been a rebar which has a pattern extending continuously along its entire length. Therefore, the bar would be cut to an appropriate length to serve as a mine roof bolt and then the raised pattern on several inches of one end of the bar would be removed either be swaging or grinding. Then, threads would be rolled or cut onto that end of the bar to recieive the nut. This practice has presented a number of problems.

First, the pattern traditionally found a rebar—usually a diamond-shaped pattern, is not ideal for use as a mine roof bolt. Furthermore, it is expensive and time consuming to individually swage or grind off the pattern on each of many hundreds or thousands of bolts after they are cut and before they are threaded.

These and other problems are resolved by manufacturing a metal, preferably steel, bar with intermittent smooth surface segments and patterned relief segments, as described below. The invention disclosed herein permits a length of bar to be cut to the desired length for use as a mine roof bolt and immediately threaded to receive a nut without intermediate processing.

SUMMARY OF THE INVENTION

Therefore, it is an object of the invention to provide a method for manufacturing steel bar with intermittent smooth surface segments and patterned relief segments.

It is another object of the invention to provide a metal bar with patterned relief segments particularly suitable for use as mine roof bolts.

It is yet another object of the present invention to provide a method for manufacturing metal bar which can be cut to any desired length for use as a mine roof bolt and yet provide a smooth surface ready to receive threads.

It is still another object of the present invention to provide a metal bar for use as a mine roof bolt having a pattern on its surface which provides quick and efficient agitation of a surrounding adhesive material as the bar is rotated and is held securely by the adhesive when set.

These and other objects of the present invention are achieved in the preferred embodiment disclosed below by providing, first, a method for manufacturing metal bar with intermittent smooth surface segments and patterned relief segments which comprise the steps of heating the metal bar to a semiplastic state, rolling the semiplastic metal between rollers having segments of patterned relief around their respective circumferences separated by intermittent smooth segments, and cooling the metal bar to a solid state with the intermittent pattern intact on the surface of the bar. Preferably, the rollers rotate in registration with each other thereby imparting a corresponding intermittent pattern to the surface of the bar along its length.

Preferably, the metal from which the bar is manufactured comprises steel and the patterned segments extend approximately 15 centimeters along the length of the bar before being interrupted by a segment of smooth surface.

Preferably, the rollers have the pattern relief engraved therein to form a raised relief pattern on the bar.

In accordance with the product according to this invention, the metal bar is provided with intermittent segments of patterned relief separated by intermittent smooth segments. The intermittent segments of patterned relief are rolled onto the surface of the bar by passing the bar in a semiplastic state between rollers having a corresponding patterned relief engraved intermittently around their respective circumferences.

According to the preferred embodiment disclosed below, the segments of patterned relief are comprised of a plurality of rows of separate x-shaped structures extending intermittently along the length of the bar. The smooth segments of the bar provide a ready surface on which screw threads can be formed for receiving a mating nut.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENT

Figure 1:
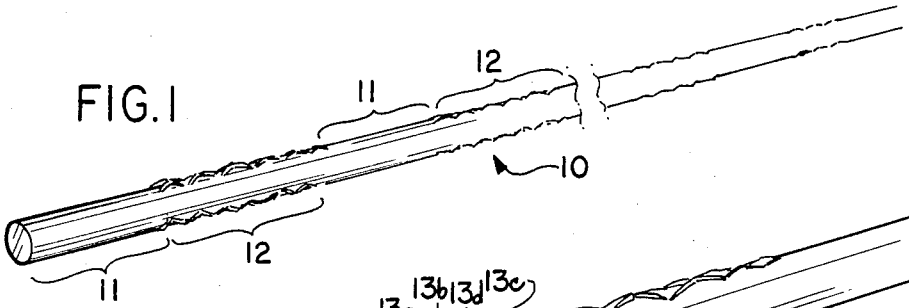
FIG. 1 is a perspective view of a length of metal bar according to the present invention.

Referring now specifically to the drawings, a steel reinforcing bar product according to the present invention is shown and generally designated at broad reference numeral 10. The steel itself is a conventional reinforcing bar-type steel having a minimum yield strength of 75,000, a minimum tensile strength of 100,000 PSI and a minimum of 8% elongation. The bar is manufactured in several sizes, including 6 bar ($\frac{3}{4}$ inch 1.9 cm.) and 7 bar ($\frac{7}{8}$ inch 2.2 cm.)). As is shown in FIG. 1, bar 10 includes intermittent smooth surface segments 11 and patterned relief segments 12 extending along its length. Preferably, each segment 11 and 12 is approximately six inches in length along the entire length of the bar. Therefore, the 10 bar may be cut to any desired length within a six inch range exposing a smooth segment 11 at the end to receive threads.

Figure 2:
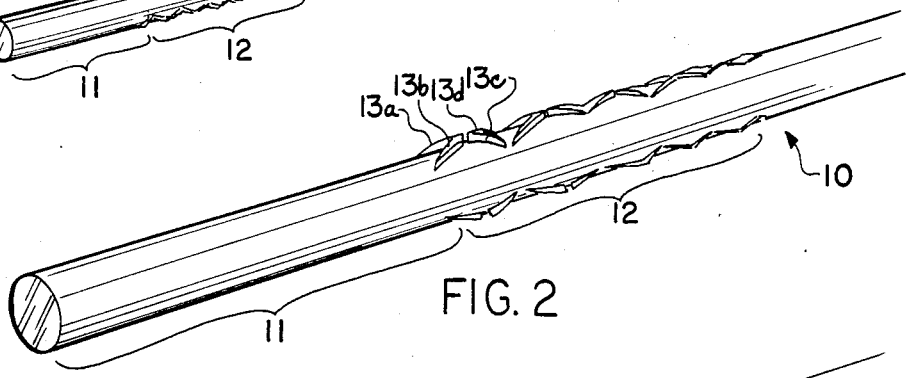
FIG. 2 is an enlarged, perspective view of the length of metal bar shown in FIG. 1, to further illustrate the shape and size of the raised relief pattern.
Figure 3:
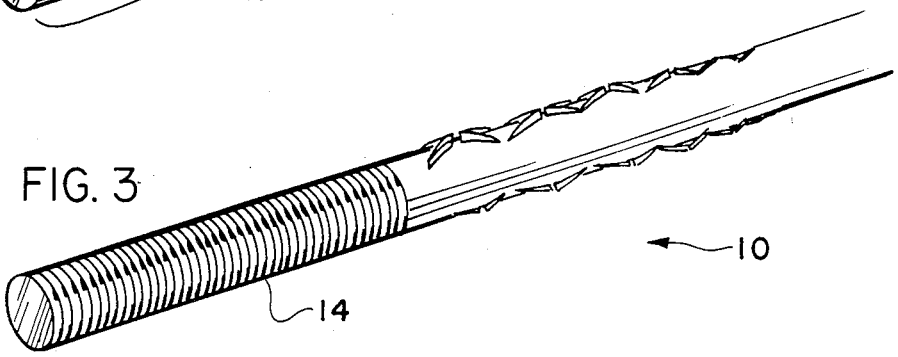
FIG. 3 shows the length of bar in FIG. 2 after threads have been formed on the smooth surface segments.

Referring now to FIG. 2, the intermittent patterned relief segments 12 extend in opposing rows down opposite sides of bar 10. Each pattern segment is composed of two rows of five x-shaped structures having outwardly extending fingers 13A through 13D. Preferably, these fingers at their greatest thickness extend above the surface of the bar approximately 0.040 inches (1 mm.). In FIG. 3, threads 14 are shown rolled onto smooth segment 11 adjacent the end of the bar 10.

Figure 4:
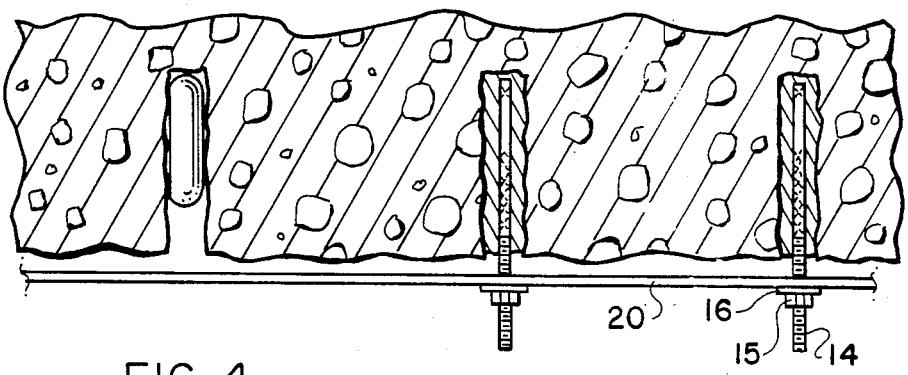
FIG. 4 illustrates the manner in which a length of the metal bar according to this invention is used as a mine roof bolt.

The above-described construction is ideal for the manufacture of mine roof bolts. Referring now to FIG. 4, the mine roof bolts are used in the following manner. First, a one inch hole (2.5 cm.) is drilled in the mine roof to the desired length. Depending upon the type of soil and/or rock which forms the mine ceiling, the mine roof bolt may be anywhere from 12 inches (30.5 cm.) to as much as 96 inches (244 cm.) long. The hole is drilled to the appropriate length and a "sausage" of epoxy, which comprises a powder epoxy material with a liquid in a separate membrane, is inserted into the hole. The mine roof bolt is then inserted into the hole and the bar is put in a torque wrench and driven into the hole at 300 RPM. The bar ruptures the sausage membrane and stirs the epoxy powder and liquid together. The epoxy is an industrial strength type which sets in several seconds, securely anchoring the mine roof bolt into the hole.

Still referring to FIG. 4, a roof panel 20 having suitably positioned holes therein is positioned with the threaded ends 14 extending through the holes. Then, a nut 15 and if necessary a large washer 16, is placed onto the threaded end which holds the ceiling panel 20 in position.

It is important to note that the threads 14 are rolled onto bar 10 and not cut. Therefore, the diameter of the bar increases slightly instead of decreasing.

The method by which the steel bar is manufactured is illustrated in FIGS. 5 through 8, to which reference is now made.

Figure 5:
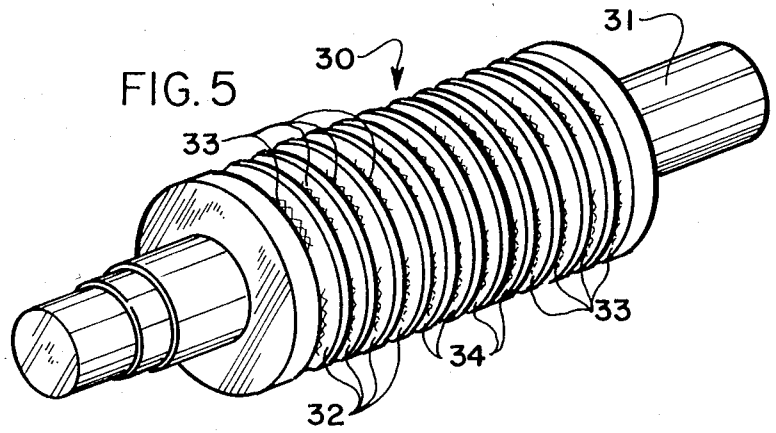
FIG. 5 is a perspective view of one of two rollers of the type which is used to create the intermittent raised pattern on the surface of the metal bar.

A roller of the type used in accordance with the present invention is shown in FIG. 5 and broadly indicated at reference numeral 30. Roller 30 is mounted on an arbor 31 and contains a plurality of individual, substantially hemispherical channels 32. As is well known in the metal rolling industry, only one of the channels 32 is used at any one time. As a channel 32 deteriorates during contact with the heated metal, the feed position of the steel bar relative to the roller 30 is shifted so that another one of the channels 32 is used. As is shown in FIG. 5, each of the channels 32 has intermittent segments of patterned relief 33 thereon, interrupted by intermittent smooth segments 34. The patterned segments 33 are formed in each of the channels 32 by engraving the appropriate pattern into the surface of channel 32 to form a depression.

Figure 6:
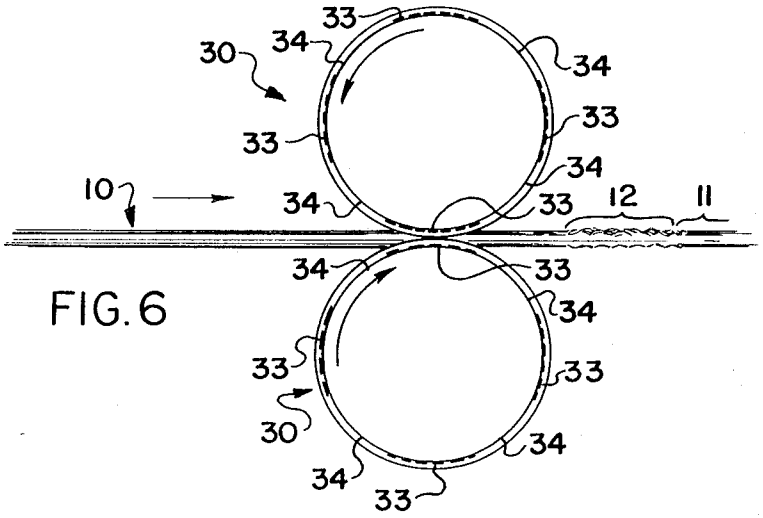
FIG. 6 is a vertical cross-sectional view of a set of rollers through which the metal bar is passed to place the raised pattern segments thereon.

Referring now to FIG. 6, two such rollers 30 are positioned in vertical and horizontal alignment with the respective channels 32 in alignment with each other. The respective channels 32 at the point of adjacency define a substantially circular passageway for the steel bar 10.

Rollers 30 are used as the last roller set in the bar forming process.

The bar enters the rolling process as a 4.5 inch by 4.5 inch by 20 foot billet which is heated to approximately 2200 degrees Fahrenheit. The billet is passed through sets of rollers having progressively smaller openings. As the rolling process takes place, the billet is reduced in cross-sectional dimension and greatly increased in length. In addition, the pass shape varies from one pass to the other with the bar assuming various oval, flat and round shapes as the bar passes through successive sets of rollers. As the bar 10 passes between rollers 30, it assumes its final shape as a substantially round bar having the intermittent smooth segments 11 and patterned segments 12. As is shown in FIG. 6, the patterned segments 33 of the respective rollers 30 are placed in registration so that the pattern is placed on opposite sides of the bar at exactly the same time. This forms the bar shown in FIGS. 1 through 4, with a plurality of x-shaped raised structures extending along opposite sides of the bar in diametrical alignment with each other.

Figure 7:
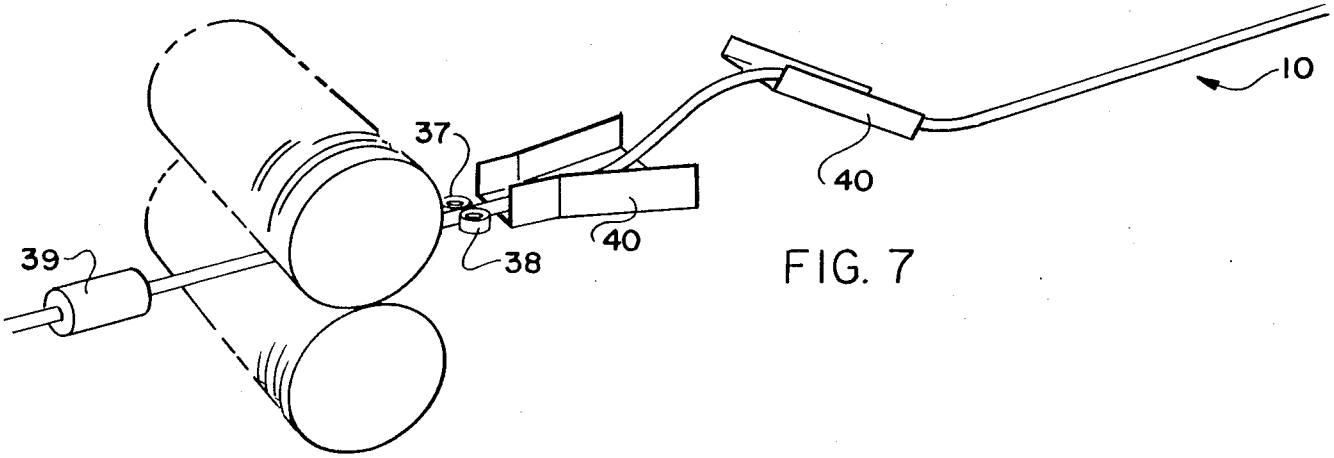
FIG. 7 is a perspective, schematic view of a short length of rolling mill line of the type used to produce the metal bar.

The final stage in the rolling process is shown schematically in FIG. 7, with the bar 10 being passed between guide rollers 37 and 38, rollers 30 and another guide 39. The looper apparatus 40 controls the tension on the bar to prevent it from stretching. Once bar 10 has passed between guide rollers 37 and 38, it is cut into an appropriate length and placed on the cooling rack. The end result is a length of bar having intermittent smooth segments 11 and patterned segments 12 which are rolled at the same time without the necessity of additional processing.

Figure 8:
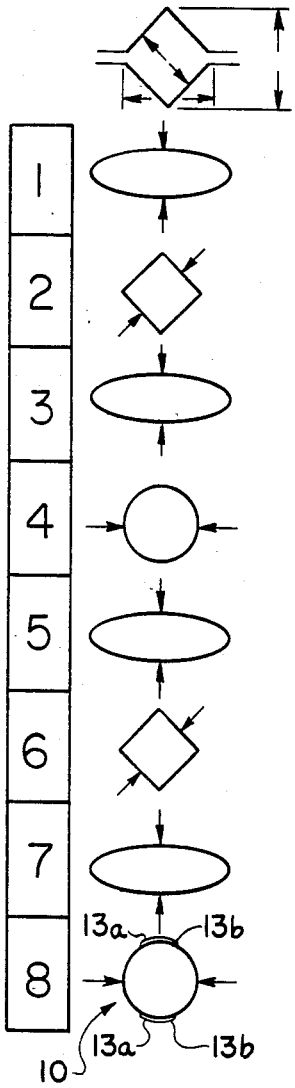
FIG. 8 is a pass diagram showing the rolling steps used in creating the metal bar from starting stock to the final metal bar product.

A pass design of one type which is suitable for manufacturing bar according to the present invention is shown in FIG. 8. As will be appreciated by those skilled in the art, the sizes of the bar cross-sections shown for the individual passes are not relative but, are intended only to indicate the various shape which is assumed during each pass. The end product of the example set forth here is a bar 43/64 of an inch (1.7 cm.) in diameter.

The billet described above is first reduced to a billet $13\frac{3}{4}$(4.4 cm.) inches on a side. Then, during successive passes, the bar assumes the shape and sizes indicated in FIG. 8, concluding with the thickness indicated after the eighth pass. The raised segments 13A and 13B shown on the bar after the eighth pass are in exaggerated scale.

As is apparent, a variety of patterns may be applied to the bar, depending entirely upon the end use of the bar. Furthermore, while the smooth segments 11 and patterned segments 12 in the embodiment shown in this application are of approximately the same length, this need not be the case in all circumstances. It has been found that the x-shaped pattern is effective to quickly mix the epoxy compound contained in the bolt hole and, at the same time, provide secure gripping surface against which the epoxy can harden.

A method of manufacturing metal bar and a metal bar product suitable for use as mine roof bolts are described above. Various details of the invention may be changed without departing from its scope. Furthermore, the foregoing description of a preferred embodiment of the method and product according to the present invention is provided for the purpose of illustration only and not for the purpose of limitation—the invention being defined by the claims.

I claim:

1. A method of manufacturing a mine roof bolt comprising the steps of:

(a) heating solid metal bar to a semiplastic state;

(b) rolling the semiplastic metal bar between rollers having segments of patterned relief around their respective circumferences separated by intermittent smooth segments, said rollers rotating in registration with each other thereby imparting a corresponding intermittent pattern to the surface of the bar along its length;

(c) cooling the metal bar to a solid state with the intermittent pattern intact on the surface of the bar;

(d) cutting the bar into a predetermined required length at the juncture of a said patterned segment and a said smooth segment to form a bolt having a smooth segment on at least one end portion thereof; and (e) forming threads onto the end of the bolt having said smooth segment to receive a mating bolt.

2. A method according to claim 1, wherein each patterned segment extends approximately 15 centimeters along the length of the bar.

3. A method according to claim 1, wherein the step of rolling the semiplastic bar comprises rolling the bar so that it is substantially circular in cross-section.

4. A method according to claim 1, wherein the step of rolling the semiplastic bar comprises using rollers having the pattern relief engraved therein to form a raised relief pattern on said bar.

* * * * *